US007484925B2

(12) United States Patent
Carlson et al.

(10) Patent No.: US 7,484,925 B2
(45) Date of Patent: Feb. 3, 2009

(54) ROTARY AXIAL FAN ASSEMBLY

(75) Inventors: Jeremy S. Carlson, Gladstone, MI (US); Nicholas T. Pipkorn, Gladstone, MI (US); Todd R. Stevens, Marquette, MI (US)

(73) Assignee: EMP Advanced Development, LLC, Escanaba, MI (US)

( * ) Notice: Subject to any disclaimer, the term of this patent is extended or adjusted under 35 U.S.C. 154(b) by 702 days.

(21) Appl. No.: 11/125,557

(22) Filed: May 10, 2005

(65) Prior Publication Data

US 2006/0257251 A1 Nov. 16, 2006

(51) Int. Cl.
*F04D 29/58* (2006.01)

(52) U.S. Cl. ..... 415/79; 415/119; 416/193 R; 416/244 R

(58) Field of Classification Search ..... 415/79, 415/119, 191; 416/193 R, 244 R
See application file for complete search history.

(56) References Cited

U.S. PATENT DOCUMENTS

| | | | | |
|---|---|---|---|---|
| 1,986,151 | A * | 1/1935 | Johnston | 416/193 R |
| 2,154,313 | A | 4/1939 | McMahan | |
| 4,265,596 | A | 5/1981 | Katagiri et al. | |
| 4,358,245 | A | 11/1982 | Gray | |
| 4,482,302 | A * | 11/1984 | Grignon | 417/354 |
| 4,548,548 | A | 10/1985 | Gray, III | |
| 4,664,593 | A | 5/1987 | Hayashi et al. | |
| 5,445,215 | A | 8/1995 | Herbert | |
| 5,454,695 | A * | 10/1995 | Shah et al. | 416/203 |
| 5,460,485 | A | 10/1995 | Sugiyama et al. | |
| 6,024,537 | A | 2/2000 | Moreau et al. | |
| 6,139,265 | A | 10/2000 | Alizadeh | |
| 6,142,733 | A | 11/2000 | Alizadeh et al. | |
| 6,174,232 | B1 * | 1/2001 | Stoll et al. | 454/184 |
| 6,350,104 | B1 | 2/2002 | Moreau et al. | |
| 6,435,828 | B1 | 8/2002 | Bostwick | |
| 6,514,052 | B2 | 2/2003 | Bostwick | |
| 6,599,085 | B2 * | 7/2003 | Nadeau et al. | 415/119 |
| 6,648,602 | B2 | 11/2003 | Horng et al. | |
| 6,951,443 | B1 * | 10/2005 | Blakemore | 415/4.3 |
| 2002/0094275 | A1 | 7/2002 | Bostwick | |
| 2002/0182071 | A1 | 12/2002 | Belady | |

(Continued)

OTHER PUBLICATIONS

International Search Report for corresponding PCT Application No. PCT/US06/17134, mailed Jun. 18, 2008, 11 pages.

*Primary Examiner*—Igor Kershteyn
(74) *Attorney, Agent, or Firm*—Brooks Kushman P.C.

(57) ABSTRACT

The present invention provides a rotary axial fan and a stator fan for moving air through a heat exchanger for an internal combustion engine cooling system. The fan includes a hub and primary fan blades extending radially from the hub. An annular shroud is attached to the primary fan blades and supported coaxially with the central axis to limit the radial flow of air along the primary fan blades. A plurality of secondary fan blades are interposed between the primary fan blades and each have a first end attached to the annular shroud and terminate in a second end that is not attached to the hub. The stator fan includes a shroud with an array of stator fan blades supporting a hub for the radial axial fan. The size, orientation and material characteristics of the stator fan blades improve sound reduction and heat transfer of the rotary axial fan assembly.

28 Claims, 7 Drawing Sheets

U.S. PATENT DOCUMENTS

2003/0059297 A1 3/2003 Stagg
2003/0123988 A1 7/2003 Wen
2005/0081542 A1 4/2005 Braun et al.

* cited by examiner

ROTARY AXIAL FAN ASSEMBLY

STATEMENT REGARDING FEDERALLY SPONSORED RESEARCH OR DEVELOPMENT

This invention was made with Government support under Contract No. W56HZV-04-C-0020. The Government has certain rights to the invention.

BACKGROUND OF THE INVENTION

1. Field of the Invention

The invention relates to cooling systems, more particularly to a fan assembly utilized for moving air through a heat exchanger.

2. Background Art

Motor vehicles commonly utilize heat exchangers to dissipate heat collected in the operation of the motor vehicle to the ambient air. These heat exchangers include radiators for cooling an internal combustion engine or a heater core for providing heat to a passenger compartment for climate control.

Internal combustion engine cooling systems that utilize a heat exchanger may also include a rotary axial fan for enhancing the movement of air through the heat exchanger. For example, a radiator in conventional motor vehicles includes a fan rearward of the radiator for forcing air through the radiator. Typically, a shroud is provided to generally restrict the air to flow axially through the radiator and the fan. The fan may be driven directly from the operation of the internal combustion engine by a belt or the like. Also, the fan may be driven by a motor for rotating the fan and forcing the air through the exchanger, as commonly utilized for transversely mounted internal combustion engines. Air is commonly forced through a conventional heater core through a fan which is operated by the climate controls within the passenger compartment.

Fan assemblies often include a rotary axial fan that is supported by a hub on the shroud. The hub is supported by an array of stator fan blades extending inward from the shroud for structurally supporting the rotary axial fan and for permitting air to pass through the shroud. Stator fan blades, however, typically increase an associated sound level of the fan assembly.

Oftentimes, a motor may be mounted to the hub and supported by the stator fan blades of the shroud, for imparting rotation to the rotary axial fan. Heat generated can be convected from the motor by air passing through the shroud.

Conventional rotary axial fans for internal combustion engine cooling systems are lacking in performance and efficiency. A goal of the present invention is to improve the performance and efficiency of rotary axial fans for moving air through a heat exchanger for an internal combustion engine cooling system to thereby conserve energy; reduce costs in operation of the associated motor vehicle; and improve the compactness of the internal combustion engine cooling system.

SUMMARY OF THE INVENTION

An aspect of the present invention is to provide a rotary axial fan for moving air through a heat exchanger for an internal combustion engine cooling system. The fan includes a hub extending annularly about a central axis of rotation. The hub is mounted to and rotated by a drive member. A plurality of elongate spaced apart primary fan blades each have a base attached to the hub and extend radially outward from the hub. An annular shroud is attached to the plurality of primary fan blades and is supported coaxially with the central axis. The annular shroud has a generally circumferential wall portion spaced radially from the hub to limit radial flow of air along the primary fan blades. A plurality of secondary fan blades are interposed between the primary fan blades and each have a first end attached to the annular shroud and a blade section projecting from the shroud. Each secondary fan blade terminates in a second end that is not attached to the hub.

A further aspect of the present invention is to provide a rotary axial fan for moving air through a heat exchanger for an internal combustion engine cooling system, including a hub extending annularly about a central axis of rotation, which is mounted to and rotated by a drive member. A plurality of elongate spaced apart primary fan blades each have a base attached to the hub and radially extend outward. A first annular shroud is attached to the plurality of primary fan blades and is supported coaxially with the central axis. The first annular shroud has a generally circumferential wall portion spaced radially from the hub to limit the radial flow of air along the primary fan blades. A second annular shroud is attached to the plurality of primary fan blades and is supported coaxially with the central axis as well. The second annular shroud has a generally circumferential wall portion spaced radially outward from the first annular shroud to limit the radial flow of air along the primary fan blades. A plurality of secondary fan blades are interposed between the primary fan blades. Each secondary fan blade has a first end attached to one of the first and second annular shrouds and a blade section projecting therefrom and terminating a second end that is not attached to the hub.

Another aspect of the present invention is to provide a stator fan for a rotary axial fan assembly. The stator fan includes a shroud that is adapted to be mounted proximate to a heat exchanger for conveying a flow of fluid through the heat exchanger and the shroud. An array of stator fan blades extend inward from the shroud and support a hub oriented generally centrally within the shroud. The hub is adapted to receive a rotary axial fan. Each stator fan blade has a generally uniform thickness oriented generally perpendicular to a direction of fluid flow. Each stator fan blade is generally linear and is oriented offset from a radial direction relative to the hub. The thickness and orientation of the stator fan blades enhance the efficiency of fluid flow and thereby provide a reduced sound output from the rotary axial fan assembly.

The above aspects and other aspects, objects, features, and advantages of the present invention are readily apparent from the following detailed description of the preferred embodiments for carrying out the invention when taken connection with the accompanying drawings.

DETAILED DESCRIPTION OF THE PREFERRED EMBODIMENTS

Figure 1:
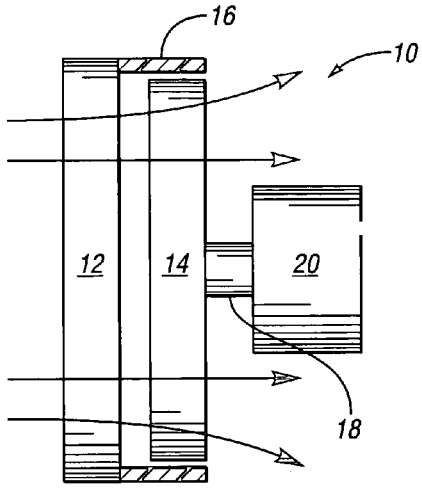
FIG. 1 is a schematic illustration of an internal combustion engine cooling system in accordance with the teachings of the present invention.

With reference now to FIG. 1, an internal combustion engine cooling system is illustrated schematically and indicated generally by reference numeral 10. The system includes a radiator indicated by reference numeral 12 that receives heated coolant from the internal combustion engine (not shown) and transfers heat from the coolant to air that passes therethrough. Air is passed through the radiator by movement of the vehicle and air is forced by a rotary axial fan 14. Commonly, an external shroud 16 is provided to limit the moving of air to travel in an axial direction. The shroud 16 is mounted to the radiator 12. The fan 14 is mounted to a drive member 18, which is driven by a motor 20. The motor 20 drives the drive member 18 and fan 14 for forcing air through the radiator 12, shroud 16 and fan 14 thereby cooling coolant that is passed through the radiator 12.

Of course, the drive member 18 can be driven directly by the internal combustion engine by a belt drive system, a gear drive system or the like. It is also appreciated that the internal combustion engine cooling system 10 may include any heat exchanger, such as a heater core, which passes coolant therethrough and air is forced by a fan 14 for passing air into the passenger compartment of a vehicle.

Figure 2:
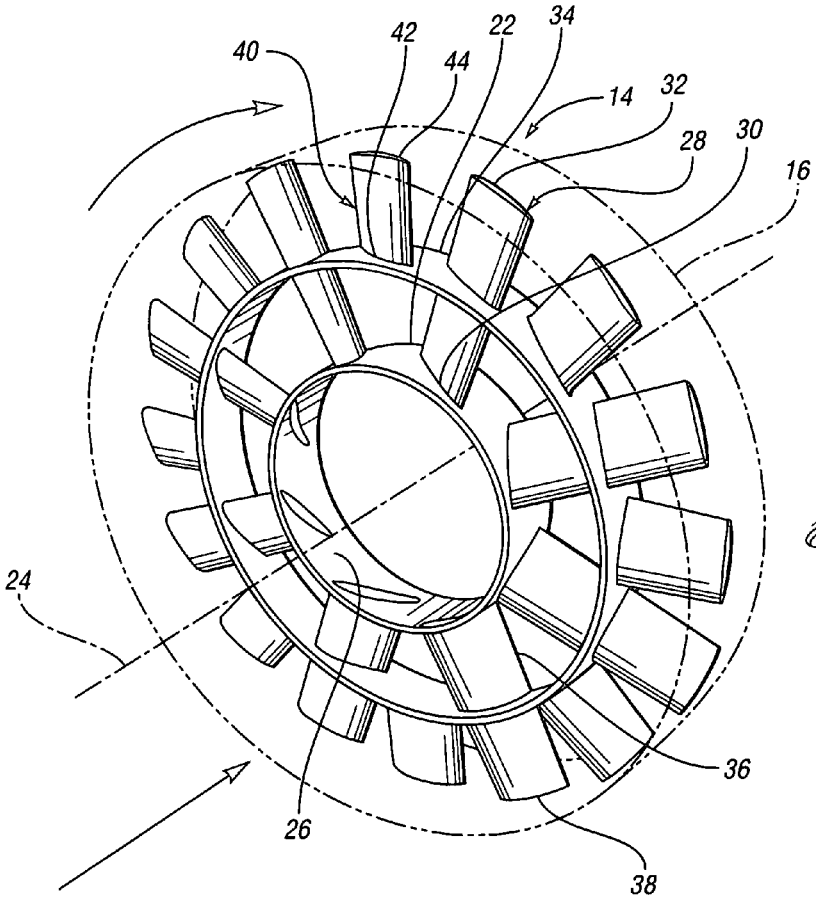
FIG. 2 is a front perspective view of a first rotary axial fan embodiment in accordance with the teachings of the present invention.

With reference now to FIG. 2, the rotary axial fan 14 is illustrated in greater detail in cooperation with the shroud 16, which is illustrated in phantom. The fan 14 includes a hub 22, which extends annularly about a central axis 24 of the fan 14. The hub 22 includes a mounting surface 26 for enabling the hub 22 to be attached to and rotated by the drive member 18. The fan 14 is driven in the clockwise direction as indicated by an arcuate arrow in FIG. 2 for forcing air through the fan 14 in the flow direction indicated by the linear arrow in FIG. 2. Of course, the fan may be driven in a counterclockwise direction opposite the arcuate arrow for forcing air through the fan 14 in a reverse flow direction than that indicated by the linear arrow.

The fan 14 includes a plurality of elongate spaced apart primary fan blades 28. Specifically, eight primary fan blades 28 are illustrated in the fan 14 of FIG. 2. However, any number of primary fan blades is contemplated by the present invention and the quantity is dictated by the requirements of a specific cooling system application. Each of the primary fan blades 28 has a base 30 attached to the hub 22. Each primary fan blade 28 extends radially outward from the hub 22 and is pitched at an angle such that rotation in the clockwise direction forces the air through the fan 14. The primary fan blades 28 terminate in a free tip 32 proximate to an internal cavity of the external shroud 16, with a tip clearance of, for example, 0.05 inches.

The fan 14 includes an annular shroud 34 that is attached to and supported by the plurality of primary fan blades 28. The annular shroud 34 is generally coaxial with the central axis 24. The annular shroud 34 has a generally circumferential wall portion that is spaced radially from the hub 22. The annular shroud 34 separates each primary fan blade 28 into a first primary fan blade segment 36 and a second primary blades segment 38. The first primary blade segment 36 includes the primary fan blade base 30. The second primary blade segment 38 includes the free tip 32.

When the fan 14 is rotated, air is primarily forced axially through the external shroud 16. However, some air flows radially outward along each primary fan 28 blade and recirculates at the free tip 32. This recirculation reduces the output pressure of the fan 14 and the efficiency of the fan 14. The wall portion of the annular shroud 34 limits radial flow of air along the primary fan blades 28 thereby reducing recirculation at the free tip 32 and enhancing output pressure and efficiency of the fan 14.

The annular shroud 34 also enhances the structural rigidity of the fan 14. The annular shroud 34 interconnects each primary fan blade 28 and reduces the cantilevered portion of each free tip 32. The fan 14 can be formed unitarily from a manufacturing process such as plastic injection molding.

The rotary axial fan 14 also includes a plurality of secondary fan blades 40. Specifically, eight secondary fan blades 40 are illustrated, each interposed between a sequential pair of primary fan blades 28. Each secondary fan blade 40 has a base 42 attached to the annular shroud 34, and a blade section projecting externally from the annular shroud 34 and terminating in a free tip 44 that is cantilevered from the annular shroud 34. The secondary fan blades 40 each have a radial length less than the radial length of the primary fan blades 28. The primary fan blades 28 and the secondary fan blades 40 collectively terminate in an outboard radial region with a clearance of, for example, 0.05 inches from the internal cavity of the external shroud 16.

The secondary fan blades 40 are illustrated having a uniform pitch with the second primary blade segment 38. However, any pitch is contemplated within the spirit and scope of the present invention.

Conventional rotary axial fans include primary fan blades that diverge outwardly thereby causing a decrease in fan blade solidity at the radially outward regions of the fan blades. The secondary fan blades 40 increase blade solidity with increasing radius of the rotary axial fan 14, and fill in the unused space provided between a sequential pair of primary fan blades 28. The secondary fan blades 40 can be formed unitarily with the rotary axial fan 14 through a manufacturing process such as plastic injection molding.

The rotary axial fan 14 has primary and secondary fan blades 28, 40 resulting in an increased output pressure for a given speed. Flow rate is increased as well due to the tight configuration of fan blades. Further, efficiency is improved by the addition of the secondary fan blades 40. The overall structural integrity of the primary fan blades 28 and secondary fan blades 40 is enhanced due to the annular shroud 34.

Of course, any number of primary fan blades 28 and secondary fan blades 40 is contemplated by the present invention. The number of fan blades, the separation of fan blades, and the output pressures and flow rates are dictated by the requirements of a specific application that requires a rotary axial fan. Due to the benefits provided by the rotary axial fan 14, less power is required to operate the fan 14, and a greater output pressure and flow rate are provided. Accordingly, the rotary axial fan 14 of the present invention satisfies the criteria of an internal combustion engine cooling system with a fan that is smaller or more compact than a conventional rotary axial fan that would provide the same output results. Accordingly, the fan 14 of the present invention provides a more compact and efficient cooling system.

Figure 3:
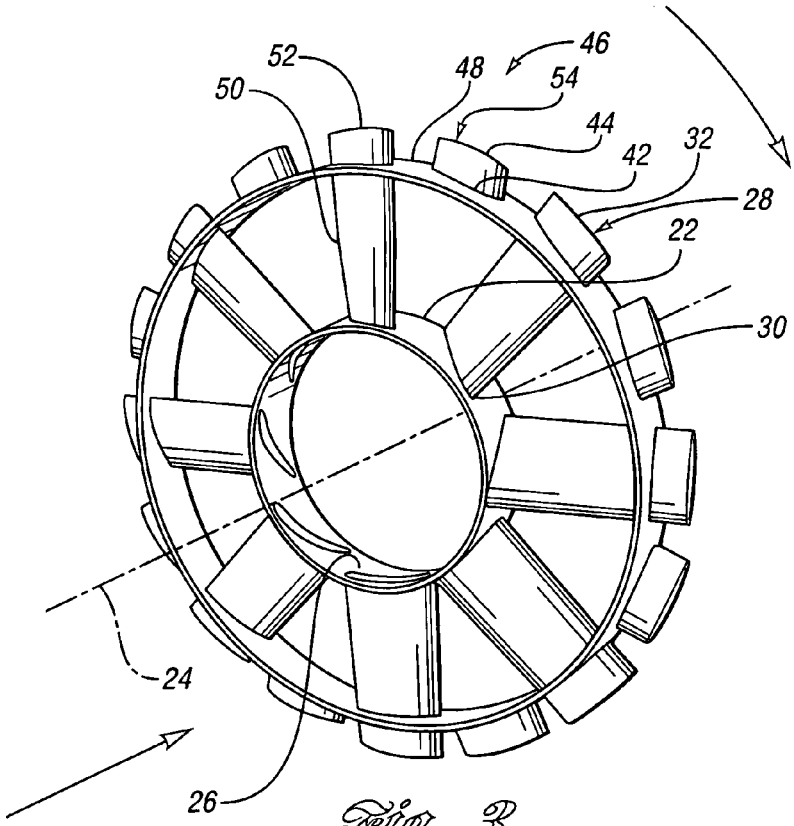
FIG. 3 is a front perspective view of another rotary axial fan embodiment in accordance with the teachings of the present invention.

With reference now to FIG. 3, an alternative embodiment rotary axial fan 46 is illustrated in accordance with the teachings of the present invention. Like elements retain same reference numerals wherein new elements are assigned new reference numerals. The rotary axial fan 46 of FIG. 3 is similar to the rotary axial fan 14 of FIG. 2, and includes a hub 22 and a series of primary fan blades 28. However, the rotary axial fan 46 includes an annular shroud 48 with an increased diameter such that the shroud 48 is spaced further outboard from the hub 22 than that of the prior embodiment. Accordingly, each primary fan blade 28 is comprised of a first primary blade segment 50 and a second primary blade segment 52, wherein the radial length of the first primary blade segment 50 is substantially greater than that of the second primary blade segment 52.

The fan 46 also includes a series of secondary fan blades 54 which extend radially outward from the annular shroud 48. Due to the outward spacing of the annular shroud 48, in comparison to the prior embodiment, recirculation at the free tips 32 of the primary fan blades 28 is reduced due to the shortened length of the second primary blade segment 52. However, the solidity of the fan 46 is less than that of the prior embodiment because the secondary fan blades 54 occupy less of the separation region than the prior embodiment. Both embodiments add blockage by the addition of the annular shrouds 34, 48, however the output results are enhanced due to the addition of the secondary fan blades 40, 54.

Figure 4:
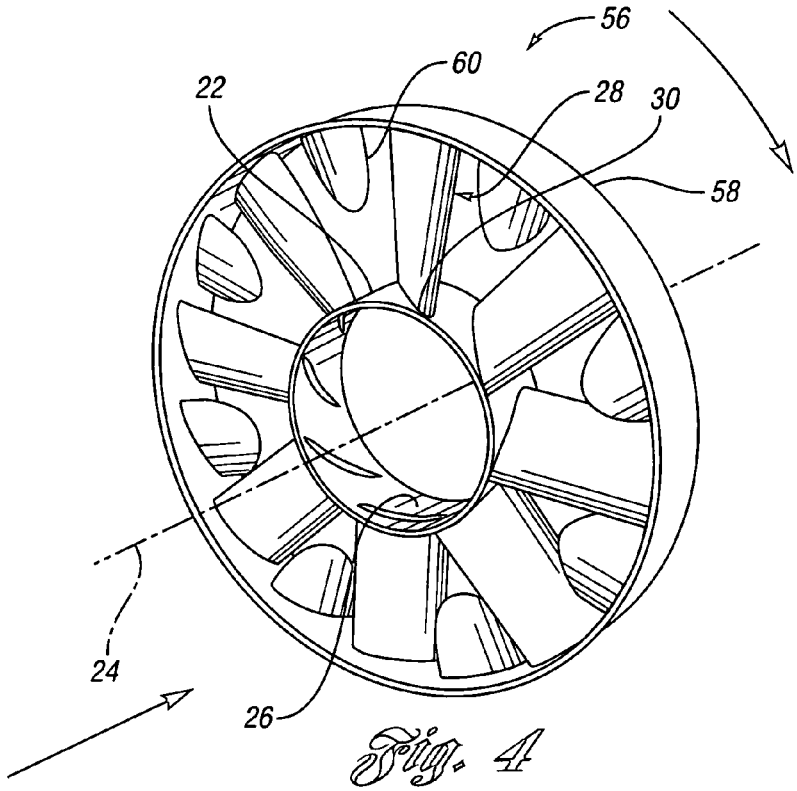
FIG. 4 is a front perspective view of a preferred rotary axial fan embodiment in accordance with the teachings of the present invention.

With reference now to FIG. 4, a preferred embodiment rotary axial fan 56 is illustrated in accordance with the teachings of the present invention. Similar to prior embodiments, the fan 56 includes a hub 22 and a series of primary fan blades 28. The fan 56 includes an annular shroud 58 that is attached to the radial outward ends of the primary fan blades 28. Therefore, the annular shroud 58 provides the outmost radial extent of the fan 56 and is sized for clearance of, for example, 0.05 inches within the corresponding internal cavity of the external shroud 16. The fan 56 includes a series of secondary fan blades 60, each interposed between a sequential pair of primary fan blades 28. The secondary fan blades 60 are mounted to and extend inwardly from the annular shroud 58. The secondary fan blades 60 are sized to increase the solidity of the fan 56. However, the secondary fan blades 60 are sized such that the secondary fan blades 60 do not converge to the hub 22, which would result in flow blockage around the hub 22 and therefore are sized in radial length such that performance of the fan 56 is maximized.

By enhancing solidity between the separation regions of the primary fan blades 28, less slip or flow deviation is permitted at the trailing edge of the primary fan blades 28 and the secondary fan blades 60. Thus, a higher output pressure is provided with minimized recirculation caused by radial flow. Accordingly, the fan 56 maximizes performance and efficiency.

Figure 5:
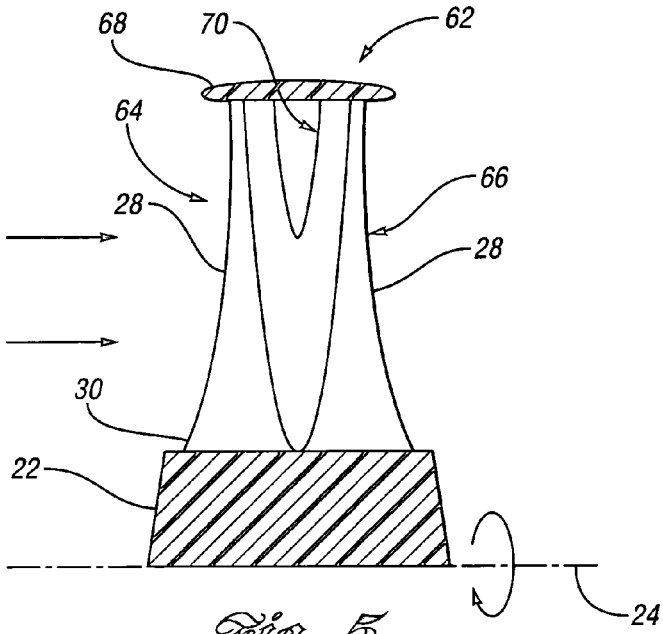
FIG. 5 is a side partial section view of an alternative embodiment rotary axial fan in accordance with the teachings of the present invention.
Figure 6:
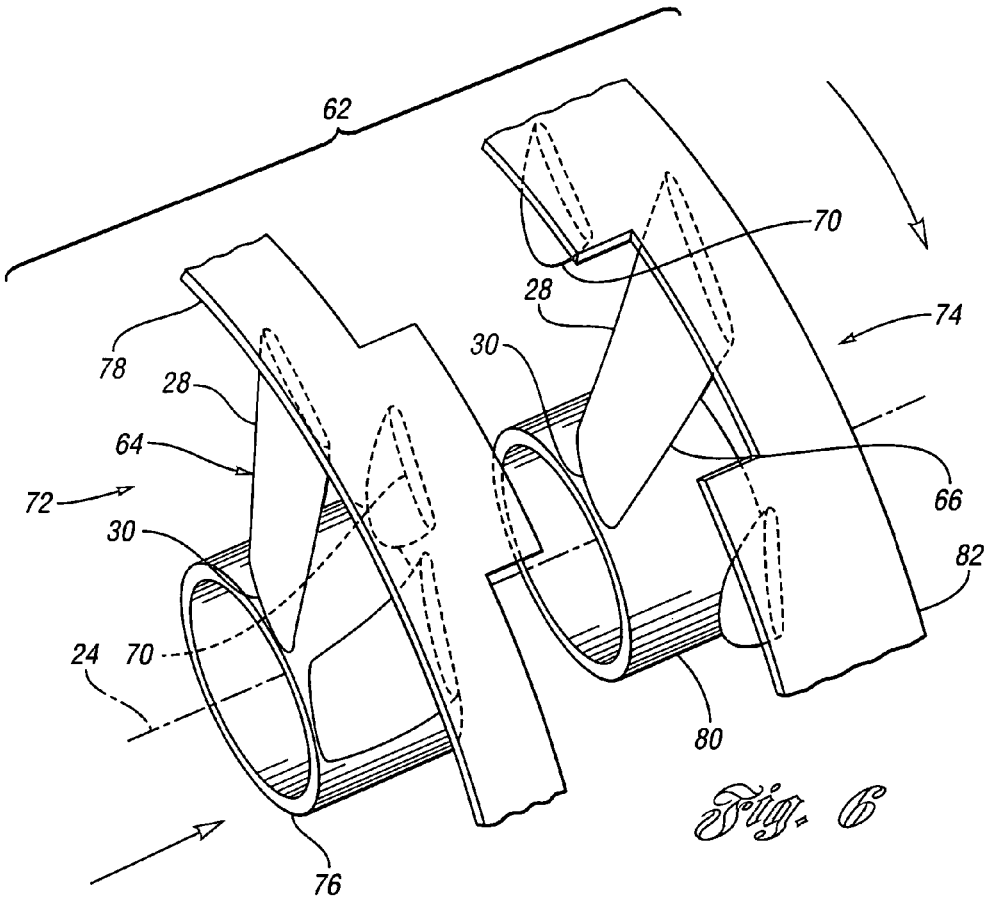
FIG. 6 is a partially exploded front perspective view of the rotary axial fan of FIG. 5.

With reference now to FIGS. 5 and 6, an alternative embodiment rotary axial fan 62 is illustrated in accordance with the teachings of the present invention. The fan 62 includes a first array of primary fan blades 64 and a second array of primary fan blades 66. Each array 64, 66 is arranged about the hub 22 in an axially stacked manner. Additionally, as best illustrated in FIG. 6, the second array of primary fan blades 66 is rotationally offset from the first array of primary fan blades 64. This offset is one half the angular dimension between a sequential pair of primary fan blades in the first array 64.

The fan 62 includes an annular shroud 68 attached to and supported by the terminal ends of the primary fan blades 28. The annular shroud 68 interconnects the first and second arrays of primary fan blades 64, 66 and minimizes recirculation at the terminating ends of the primary fan blades 28. Additionally, the fan 62 includes a series of secondary fan blades 70 extending inwardly from the annular shroud 68. The secondary fan blades 70 are in stacked coaxial alignment with the first and second arrays of primary fan blades 64, 66. The secondary fan blades 70 are spaced apart from each array 64, 66 and are oriented therebetween.

Referring specifically now to FIG. 6, the rotary axial fan 62 is illustrated exploded with a first fan portion 72 and a second fan portion 74. The first fan portion 72 is molded integrally with a hub portion 76, the first array of primary fan blades 64, a first shroud portion 78 and half of the series of secondary fan blades 70. Likewise, the second fan portion 74 is molded integrally and includes a second hub portion 80, the second array of primary fan blades 66, a second shroud portion 82 and half of the plurality of secondary fan blades 70. The first hub portion 76 and the second hub portion 80 are sized to engage one another and the first shroud portion 78 and the second shroud portion 82 are sized to engage one another. After the molding processes of the first and second fan portion 72, 74, the fan portions are engaged and bonded theretogether by a manufacturing process such as sonic welding.

The stacked axial fan blades 64, 70, 66 provide twice the output pressure in comparison with the conventional design at the same operating speed and flow rate. Although the fan 62 may require more manufacturing processes and components than the conventional rotary axial fan, the stacked axial fan 62 provides more output in a reduced and compact fan size. Additionally, the output results and efficiency are improved by reduced recirculation provided by the annular shroud 68 and increased solidity that is maximized with the stacked primary fan blades 64, 66 and the interposed secondary fan blades 70.

Figure 7:
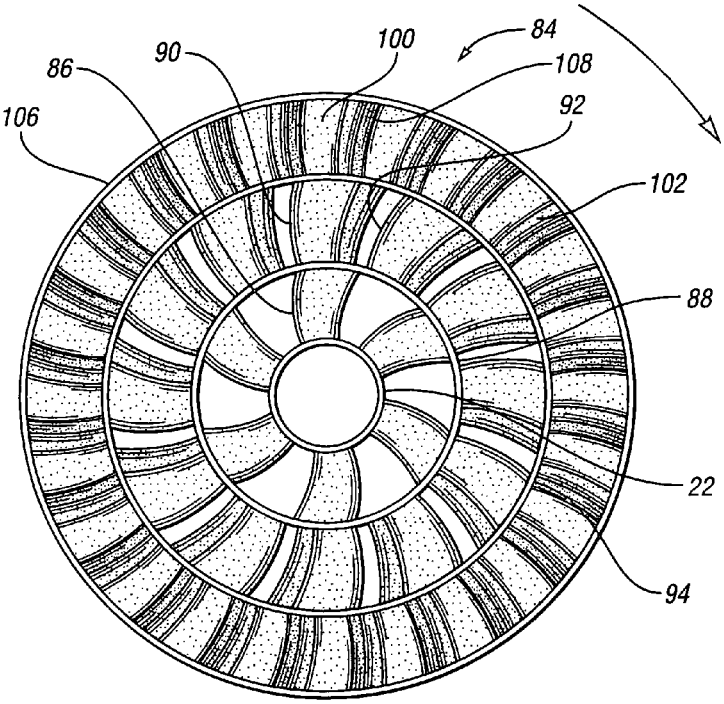
FIG. 7 is a front elevation view of another alternative embodiment rotary axial fan in accordance with the teachings of the present invention.
Figure 8:
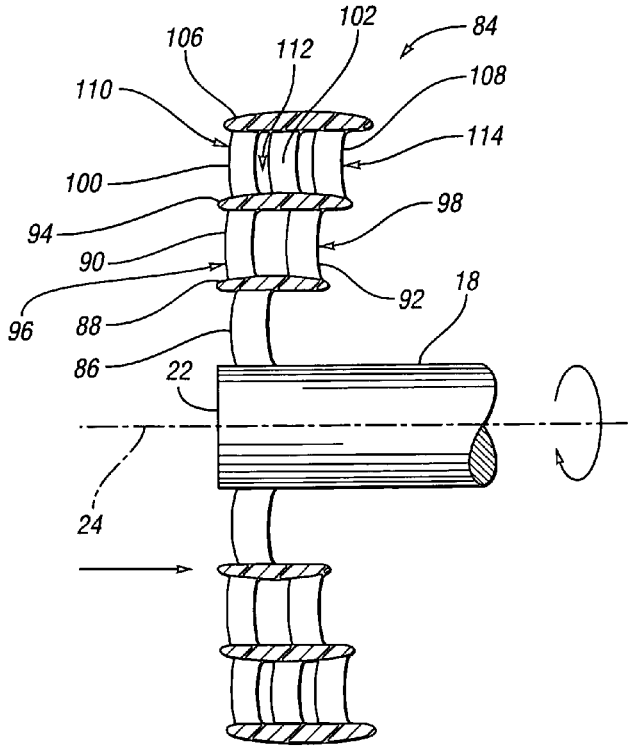
FIG. 8 is a side partial section view of the rotary axial fan of FIG. 7.

With reference now to FIGS. 7 and 8, another alternative embodiment rotary axial fan 84 is illustrated for moving air through a heat exchanger in an internal combustion engine cooling system. The fan 84 includes a hub 22, which is driven by a drive member 18 for rotation of the fan 84 in a clockwise direction. The fan 84 includes a series of primary fan blade segments 86 extending outward in a radial direction. A first annular shroud 88 is attached to and oriented about the plurality of first primary fan blade segments 86. A plurality of second primary fan blade segments 90 extend radially outward from the first annular shroud 88. The quantity of second primary fan blade segments 90 is equal to that of the first primary fan blade segments 86 and each second primary fan blade segment 90 is aligned with a corresponding first primary fan blade segment 86. Additionally, a series of first secondary fan blade segments 92 are each provided interposed between a sequential pair of second primary fan blade segments 90 and are attached to and extending outwardly from the first annular shroud 88.

A second annular shroud 94 is provided attached to the outward end of each second primary fan blade segment 90 and each outward end of each first secondary fan blade segment 92. The second annular shroud 94 reduces recirculation at the outward radial ends of the second primary fan blade segments 90 and the first secondary fan blade segments 92 and provides structural rigidity by interconnecting these fan blade segments 90, 92. To enhance pressure and flow provided by the fan 84, the second primary fan blade segments 90 and the first secondary fan blade segments 92 are arranged in a first array 96 and a second array 98. The first and second arrays 96, 98 are stacked axially, both of which are connected to the first annular shroud 88 and the second annular shroud 94. Additionally, the second array 98 is rotationally offset from the first array 96.

A series of third primary fan blade segments 100 extend radially outward from the second annular shroud 94. A second secondary fan blade segment 102 is interposed between each sequential pair of third primary fan blade segments 100, and is aligned with the corresponding first secondary fan blade segment 92. To reduce recirculation at the outward most region of the rotary axial fan, specifically the location of the terminating ends of the third primary fan blade segments 100 and the second secondary fan blade segments 102, a third annular shroud 106 is provided attached to the outward radial terminal end of the third primary fan blade segments 100 and the second secondary fan blade segments 102.

To enhance solidity at the region between the second annular shroud 94 and the third annular shroud 106, a tertiary fan blade 108 is provided between each sequential pair of third primary fan blade segments 100 and second secondary fan blades segments 102. To further enhance performance in the region between the second annular shroud 94 and the third annular shroud 106, the third primary fan blade segments 100, the second secondary fan blade segments 102 and the tertiary fan blade 108 are provided in a first array 110, a second array 112 and a third array 114. These three arrays 110, 112, 114 are stacked axially and are each attached to the second annular shroud 94 and the third annular shroud 106. Additionally, each of these arrays 110, 112, 114 are rotationally offset.

The rotary axial fan 84 illustrated in FIGS. 7 and 8 illustrates that any number of annular shrouds, any number of secondary and subsequent fan blades, and any number of arrays of fan blades is contemplated within the present invention and is prescribed by the requirements of the specific heat exchanger in an internal combustion engine cooling system. The annular shrouds reduce recirculation and increase efficiency. The secondary and subsequent fan blades enhance performance and increase efficiency. The stacked arrays increase performance as well. Accordingly, the rotary axial fan of the present invention satisfies the cooling requirements of a given system with enhanced performance and efficiency and reduced size in comparison to the prior art.

Figure 9:
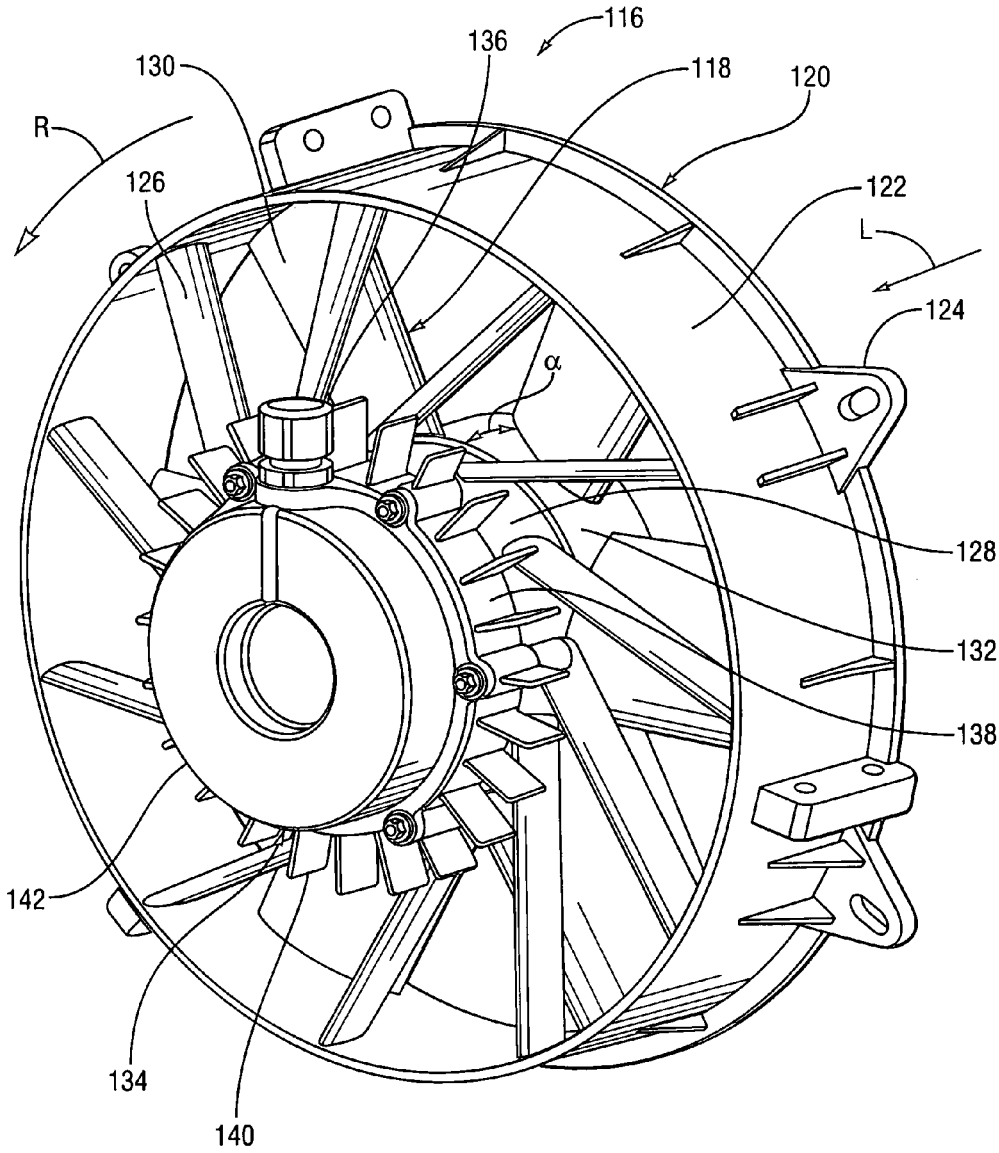
FIG. 9 is a perspective view of a rotary axial fan assembly in accordance with the present invention.

With reference now to FIG. 9, a rotary axial fan assembly 116 is illustrated in accordance with the teachings of the present invention. The fan assembly 116 includes a rotary axial fan 118 and a stator fan 120. The stator fan 120 is fixed within the vehicle and supports the rotary axial fan 118.

The stator fan 120 includes a shroud 122, which is generally annular for limiting a direction of air flow through the assembly 116 to a generally axial direction. The shroud 122 includes a plurality of mounting flanges 124 for mounting the assembly 116 proximate to a heat exchanger such as a radiator. The stator fan 120 includes a radial array of stator fan blades 126 converging centrally inward to a hub 128, and each lying in a plane generally parallel to an axial flow direction L. The hub 128 is supported by the stator fan blades 126. The rotary axial fan 118 is mounted to the hub 128 for rotation relative thereto. The rotary axial fan 118 includes a series of rotary fan blades 130 extending from a rotary hub 132. The rotary fan blades 130 are inclined relative to the axial flow direction at an attack angle $\alpha$, which is angled (non-radial) relative to the hub 132 such that rotation of the rotary axial fan 118 in a counterclockwise direction, as illustrated by the arcuate arrow R in FIG. 9, causes a flow of air in a generally axial direction through the shroud 122, as illustrated by the linear (axial) directional arrow L in FIG. 9.

Although the fan assembly 116 is illustrated as a puller fan assembly, wherein air is pulled through the radiator and subsequently through the fan assembly 116, the invention contemplates that the rotary axial fan 118 may be rotated in a clockwise direction such that air is forced in a reverse linear direction relative to the arrow L depicted in FIG. 9 for pushing air through the fan assembly 116 and subsequently through the associated radiator. Such rotation may be controlled by electronics or may be a function of the relationship of the rotary axial fan blades 130 relative to the hub 132. Alternatively, the rotary axial fan 118 may be detachable from the stator fan 120 for being mounted in either a pusher or puller orientation.

Figure 10:
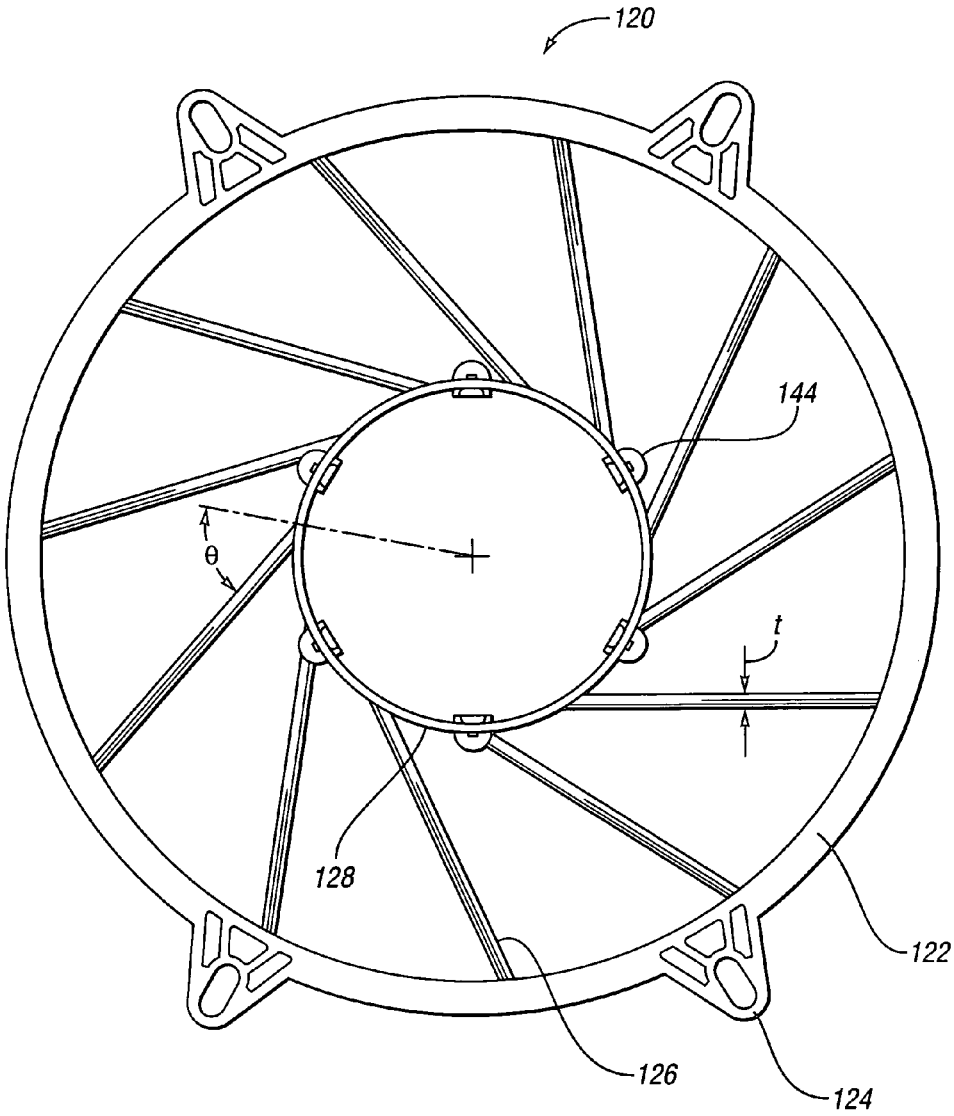
FIG. 10 is an axial end view of a stator fan of the rotary axial fan assembly of FIG. 9.
Figure 11:
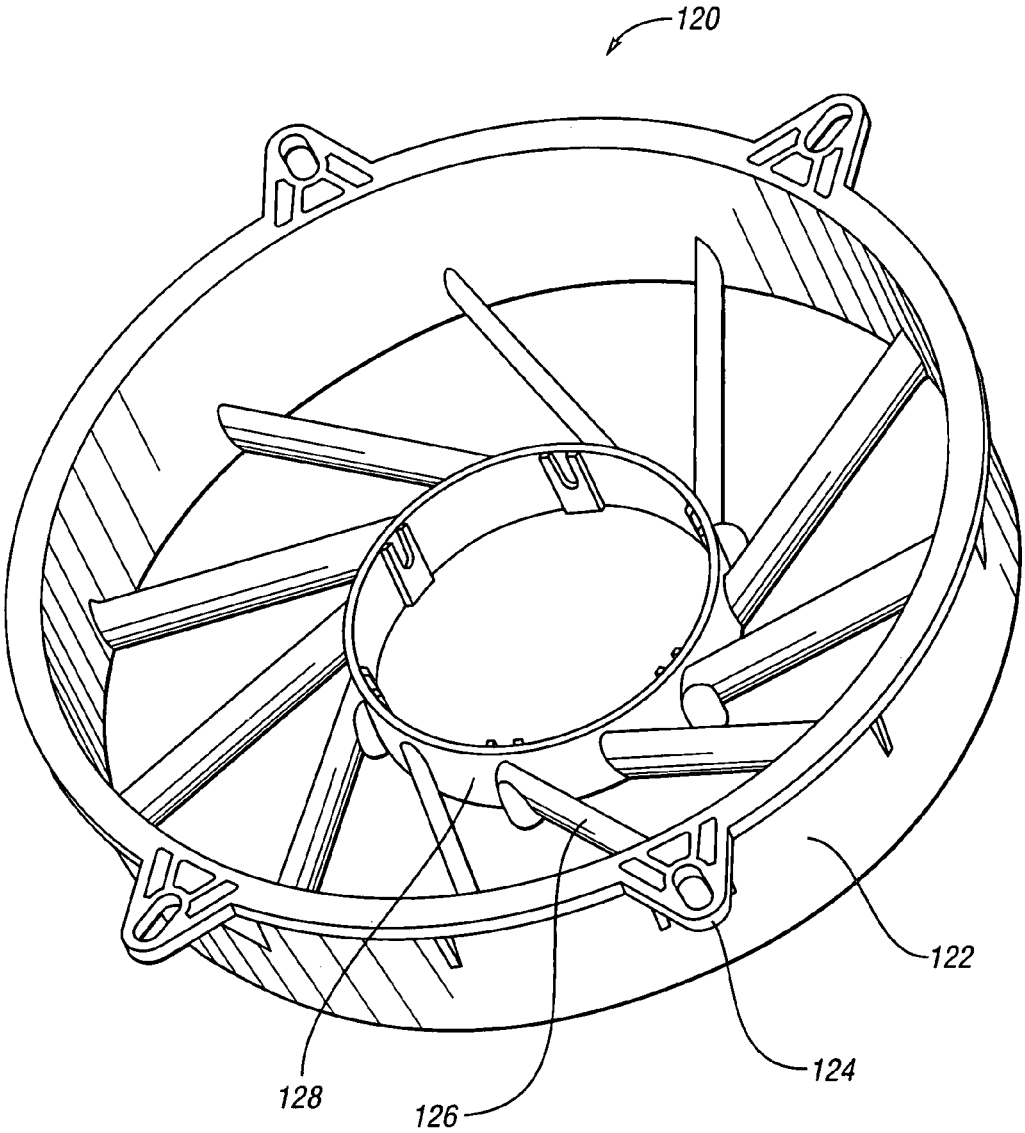
FIG. 11 is a perspective view of the stator fan of the rotary axial fan assembly of FIG. 9.

With continued reference to FIG. 9 and reference to FIGS. 10 and 11, the stator fan 120 reduces an output sound level in comparison to prior art stator fans due to the characteristics of the stator fan blades 126 which optimize the interaction of flowing air with the blades 126.

By conducting studies through computational fluid dynamics, a stator fan design may be developed for a particular application, and subsequently prototyped and tested to provide a stator fan blade arrangement that minimizes output sound level of the stator fan 120. Heat transfer factors may be considered in to these processes for maximizing cooling. For example, the fan assembly 116 illustrated in FIG. 9 is sized to adequately cool a radiator of a predetermined diesel engine. Of course, other types of engines, engine cooling systems, and cooling of other heat exchangers is contemplated by the present invention.

For the given application, the rotary fan blade 118 is rotationally driven by a motor 134 that is mounted to the stator fan hub 128. The rotary axial fan 118 is rotated relative to the stator fan 120. The motor 134 illustrated in FIG. 9 may be, for example, a brushless DC motor having a fitting 136 for receiving and ducting wiring to the motor 134. In order to cool the motor 134, a motor casing 138 may be provided for utilization as a heat sink for conducting heat from the motor 134 into the flow of air via a radial array of heat fins 140 extending radially outward from the motor casing 138, each lying in a plane generally parallel to the axial flow direction L. Thus, heat that is generated by the motor 134 is transferred therefrom by the flow of air across the fins 140. The motor casing 138 may be formed from a thermally conductive material for facilitating this heat transfer; for example, the motor casing 138 may be formed from aluminum, and may be die cast.

The motor casing 138 may include a motor stator encapsulated therein for imparting the rotation to an associated motor rotor mounted upon an output shaft to which the rotary axial fan 118 is mounted. Thus, heat from operation of the motor 134 is conducted directly from the motor stator to the motor casing 138. The fan motor stator may be encapsulated within a thermally conductive polymer and pressed into the motor casing 138 for heat transfer from the stator through the conductive polymer to the motor casing 138 and subsequently to the fins 140, thereby increasing the efficiency of heat transfer and consequently cooling of the motor 134.

In order to optimize both heat transfer and sound reduction of the stator fan blades 126, an exemplary arrangement of stator fan blades 126 is illustrated in FIGS. 9-11. The stator fan blades 126 each extend from the hub 128 at an angle that is offset from a radial direction relative to the hub 128. This offset from a radial direction is indicated in FIG. 10 by $\theta$. For optimizing sound reduction, the offset angle $\theta$ may be approximately seventy-five degrees. The direction of the offset may be opposed to a radial rotation of the rotary axial fan 118. Linear stator fan blades 126 facilitate optimal sound reduction, however, non-linear stator fan blades are contemplated within the spirit and scope of the present invention.

Also, for minimizing a resultant sound level output, the stator fan blades 126 are oriented so that a width (in axial flow direction) of the fan blades 126 is oriented in a generally axial direction of the stator fan 120 and a thickness, referenced by label t, of the stator fan blades 126 is oriented generally perpendicular to the plane of the fan blade 126.

For optimizing structural support of the hub 128, which supports the motor 134 and rotary axial fan 118, an optimal number of stator fan blades 126 and an optimal width and thickness of the stator fan blades 126 may be determined for structural integrity, noise reduction, and heat transfer for a predetermined cooling application. For the illustrated application, eleven stator fan blades 126 are utilized. Each stator fan blade has a width that is substantially greater than the thickness for convection of air along the axial surfaces thereof. Accordingly, each stator fan blade 126 is provided with a thickness t within a range of four to five millimeters.

The motor 134 includes an axially end cap 142. The end cap 142 and the motor casing 138 are illustrated fastened directly to an array of mounting bosses 144 displaced about the stator hub 128. Thus, heat from the motor 134 is also directly conducted to the stator fan hub 128. Accordingly, the stator fan 120 may be formed from a thermally conductive material for dissipating heat from the motor 134 to the stator fan blades 126, for subsequently cooling from the flow of air therethrough. For example, the stator fan 120 illustrated in FIGS. 9-11 may be die cast from aluminum for diesel and industrial applications. Of course, the invention contemplates that the stator fan 120 may be formed integrally, from separate components, and from various component materials. The invention contemplates that the stator fan 120 may be formed from other materials, such as from thermally conductive polymers which may be manufactured from an injection molded process.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A rotary axial fan for moving air through a heat exchanger for an internal combustion engine cooling system, comprising:

a hub extending annularly about a central axis of rotation having a mounting surface enabling the hub to be attached to and rotated by a drive member;

a plurality of elongate spaced apart primary fan blades each having a base attached to the hub and radially extending outward therefrom;

an annular shroud attached to the plurality of primary fan blades and supported coaxially with the central axis, the annular shroud having a generally circumferential wall portion spaced radially from the hub to limit radial flow of air along the primary fan blades, wherein the annular shroud attaches to the plurality of primary fan blades at a radial distance less than the overall radial length of the primary fan blades and each primary fan blade is further defined by a first primary fan blade segment oriented between the shroud and the hub, and a second primary fan blade segment oriented externally from the shroud;

a plurality of secondary fan blades interposed between the primary fan blades each having a first end attached to the annular shroud and a blade section projecting therefrom and terminating in a second end that is not attached to the hub; and a stationary external shroud provided about the second primary fan blade segments to limit the air to travel in an axial direction, proximate to a free tip of the second primary fan blade segments.

2. The rotary axial fan of claim 1 wherein the secondary fan blades have a radial length less than the radial length of the primary fan blades.

3. The rotary axial fan of claim 1 wherein the primary and secondary fan blades all have a generally uniform pitch at a given radial distance from the central axis.

4. The rotary axial fan of claim 1 wherein the secondary fan blades project from the annular shroud in a cantilevered manner.

5. The rotary axial fan of claim 1 wherein the secondary fan blades project radially inward from the annular shroud.

6. The rotary axial fan of claim 1 wherein the secondary fan blades project radially outward from the annular shroud.

7. A rotary axial fan for moving air through a heat exchanger for an internal combustion engine cooling system, comprising:

a hub extending annularly about a central axis of rotation having a mounting surface enabling the hub to be attached to and rotated by a drive member:

a plurality of elongate spaced apart primary fan blades each having a base attached to the hub and radially extending outward therefrom:

an annular shroud attached to the plurality of primary fan blades and supported coaxially with the central axis, the annular shroud having a generally circumferential wall portion spaced radially from the hub to limit radial flow of air along the primary fan blades: and a plurality of secondary fan blades interposed between the primary fan blades each having a first end attached to the annular shroud and a blade section projecting therefrom and terminating in a second end that is not attached to the hub:

wherein the secondary fan blades are spaced apart axially from the primary fan blades.

8. The rotary axial fan of claim 7 wherein the primary fan blades further comprise a first array of primary fan blades and a second array of primary blades.

9. The rotary axial fan of claim 8 wherein the second array of primary fan blades is rotationally offset from the first array of primary fan blades.

10. The rotary axial fan of claim 8 wherein the secondary fan blades are oriented axially spaced apart from and in between the first and second arrays of primary fan blades.

11. The rotary axial fan of claim 8 wherein the fan is manufactured from a first fan portion that includes the first array of primary fan blades and a second fan portion that includes the second array of primary fan blades, and the first and second fan portions are joined together by a manufacturing process.

12. The rotary axial fan of claim 11 wherein the first and second Fan portions are joined together by sonic welding.

13. The rotary axial fan of claim 7 wherein the annular shroud is further defined as a first annular shroud; and wherein the rotary axial fan further comprises a second annular shroud attached to the plurality of primary fan blades and supported coaxially with the central axis, the second annular shroud having a generally circumferential wall portion spaced radially outward from the first annular shroud to limit the radial flow of air along the primary fan blades.

14. The rotary axial fan of claim 13 wherein the secondary fan blades each have a first end attached to the first annular shroud and a second end attached to the second annular shroud.

15. The rotary axial fan of claim 13 wherein the rotary axial fan further comprises a third annular shroud attached to the plurality of primary fan blades and supported coaxially with the central axis, the third annular shroud having a generally circumferential wall portion spaced radially outward from the second annular shroud to limit the radial flow of air along the primary fan blades.

16. The rotary axial fan of claim 15 further comprising a plurality of tertiary fan blades each having a first end attached to the second annular shroud and a second end attached to the third annular shroud.

17. The rotary axial fan of claim 16 wherein each tertiary fan blade is interposed between a sequential pair of primary and secondary fan blades.

18. A rotary axial fan for moving air through a heat exchanger for an internal combustion engine cooling system, comprising:

a hub extending annularly about a central axis of rotation having a mounting surface enabling the hub to be attached to and rotated by a drive member;

a quantity of elongate spaced apart primary fan blades each having a base attached to the hub and radially extending outward therefrom;

an annular shroud attached to the plurality of primary fan blades and supported coaxially with the central axis, the annular shroud having a generally circumferential wall portion spaced radially from the hub to limit the radial flow of air along the primary fan blades; and a quantity of secondary fan blades interposed between the primary fan blades each having a base attached to the annular shroud and a blade section projecting in a cantilevered manner therefrom and terminating in a free tip, wherein an outward most region of each secondary fan blade does not exceed an overall radial length of each primary fan blade;

wherein the quantity of primary fan blades is equal to the quantity of secondary fan blades wherein the annular shroud attaches to the plurality of primary fan blades at a radial distance less than the overall radial length of the primary fan blades and each primary fan blade is further defined by a first primary fan blade segment oriented between the shroud and the hub, and a second primary fan blade segment oriented externally from the shroud.

19. A stator fan for a rotary axial fan assembly comprising;

a shroud that is adapted to be mounted proximate to a heat exchanger, the shroud being sized for conveying a flow of fluid through the heat exchanger and the shroud;

a radial array of stator fan blades extending inward from the shroud;

a hub oriented centrally within the shroud, supported by the array of stator fan blades, the hub being adapted to receive a rotary axial fan mounted thereto; and an array of mounting bosses attached to the hub for supporting a motor of the rotary axial fan;

wherein each stator fan blade is generally linear and is oriented in a plane generally parallel to a direction of the flow of fluid, and each stator fan blade is oriented offset from a radial direction relative to the hub for reduction of sound output from the rotary axial fan assembly.

20. The stator fan of claim 19 wherein each stator fan blade is offset from the radial direction relative to the hub in a direction opposed to a radial rotation of the rotary axial fan.

21. The stator fan of claim 19 wherein each stator fan blade is offset from the radial direction relative to the hub by approximately seventy-five degrees.

22. The stator fan of claim 19 wherein each stator fan blade has a generally uniform width, the width being greater than the stator fan blade thickness.

23. The stator fan of claim 19 wherein each stator fan blade thickness is five millimeters or less.

24. The stator fan of claim 19 wherein each stator fan blade thickness is within a range of four millimeters to five millimeters.

25. The stator fan of claim 19 wherein the hub is adapted to receive a motor for imparting rotation to the rotary axial fan, and the array of stator fan blades are formed from a conductive material for heat transfer from the motor to the flow of fluid for cooling the motor.

26. The stator fan of claim 25 wherein the stator fan is die-cast.

27. The stator fan of claim 19 farther comprising a radial array of heat fins mounted proximate to the hub.

28. The stator fan of claim 19 further comprising a fitting mounted proximate to the hub, for receiving and ducting wiring to the motor.

* * * * *

UNITED STATES PATENT AND TRADEMARK OFFICE

CERTIFICATE OF CORRECTION

PATENT NO. : 7,484,925 B2
APPLICATION NO. : 11/125557
DATED : February 3, 2009
INVENTOR(S) : Jeremy S. Carlson et al.

It is certified that error appears in the above-identified patent and that said Letters Patent is hereby corrected as shown below:

Column 10, Line 27, Claim 7:

Delete "member:" and insert -- member; --

Column 10, Line 30, Claim 7:

Delete "therefrom:" and insert -- therefrom; --

Column 10, Line 35, Claim 7:

Delete "blades:" and insert -- blades; --

Column 10, Line 40, Claim 7:

Delete "hub:" and insert -- hub; --

Column 10, Line 60, Claim 12:

Delete "Fan" and insert -- fan --

Signed and Sealed this

Seventh Day of April, 2009

JOHN DOLL
*Acting Director of the United States Patent and Trademark Office*